US006425386B1

(12) United States Patent
Adkins

(10) Patent No.: US 6,425,386 B1
(45) Date of Patent: Jul. 30, 2002

(54) BOWSTRING RELEASE SYSTEM FOR CROSSBOWS

(76) Inventor: Daniel K. Adkins, 13716 Carmenita Rd., Santa Fe Springs, CA (US) 90670

( * ) Notice: Subject to any disclaimer, the term of this patent is extended or adjusted under 35 U.S.C. 154(b) by 0 days.

(21) Appl. No.: 09/625,221

(22) Filed: Jul. 24, 2000

(51) Int. Cl.[7] ..... F41A 19/00
(52) U.S. Cl. ..... 124/31; 124/25; 124/35.1
(58) Field of Search ..... 124/31, 35.1, 25

(56) References Cited

U.S. PATENT DOCUMENTS 3,483,857 A * 12/1969 Jones ..... 124/25
4,693,228 A * 9/1987 Simonds et al. ..... 124/25
4,716,880 A * 1/1988 Adkins ..... 124/25
4,909,233 A 3/1990 Stephenson
4,926,835 A * 5/1990 Peck ..... 124/35.2
5,085,200 A * 2/1992 Horton-Corcoran et al. .. 124/25
5,361,747 A 11/1994 Laabs
5,365,911 A * 11/1994 Todd ..... 124/35.2
5,499,620 A 3/1996 Summers
5,546,924 A * 8/1996 Todd ..... 124/35.2
5,649,520 A * 7/1997 Bednar ..... 124/25
5,680,851 A * 10/1997 Summers ..... 124/35.2
5,685,286 A 11/1997 Summers
5,787,870 A 8/1998 Summers et al.
6,205,990 B1 * 3/2001 Adkins ..... 124/25

* cited by examiner

*Primary Examiner*—Charles T. Jordan
*Assistant Examiner*—John W. Zerr
(74) *Attorney, Agent, or Firm*—Edgar W. Averill, Jr.

(57) ABSTRACT

A bowstring release system for crossbows having a preferably ball-shaped nocking member mounted on a bowstring for engaging a nock portion of an arrow. Upper and lower surfaces of the bowstring release system are positioned near the rear of the crossbow, and move between open and closed positions relative to each other to vary the size of a release passage defined therebetween. In the closed position, the upper and lower catch surfaces are positioned sufficiently near each other to block the nocking member from passing through the release passage. And in the open position, the upper and lower catch surfaces are sufficiently separated to allow passage of the nocking member for propelling the arrow. When the bowstring is cocked, a locking mechanism actuates one or both of the upper and lower catch surfaces to the closed position, and a trigger mechanism releases the locking mechanism and actuates either one or both of the upper and lower catch surfaces to the open position.

12 Claims, 8 Drawing Sheets

BOWSTRING RELEASE SYSTEM FOR CROSSBOWS

BACKGROUND OF THE INVENTION

The field of the invention pertains to crossbows. The invention relates more particularly to a system for capturing and releasing a crossbow bowstring by means of a preferably ball-shaped nocking member centrally mounted on the bowstring, wherein a pair of preferably curved surfaces obstructs the nocking member from discharging when in a closed position, and enables a smooth controlled release of the nocking member when in an open position.

It is known for the operation of crossbows to provide a sear or other catch mechanism which maintains a bowstring in a cocked position prior to and in preparation for release by a trigger mechanism. Conventionally, a sear mechanism having a hook-type catch configuration is used to capture the bowstring directly, and a trigger mechanism actuating the sear hook is used to release the bowstring and thereby discharge a loaded arrow. Perhaps the greatest disadvantage of this arrangement, however, is the tendency of the bowstring to experience extensive wear and deterioration due to repeated frictional contact with the sear hook catch. This can lead to inaccuracy when shooting arrows, or even failure of the bowstring itself.

In an effort to reduce and/or prevent wear of bowstrings, nocking members are mounted on bowstrings to engage the nock portion of a tail end of an arrow, and/or provide an intermediate contact surface for pulling and maintaining the bowstring in a cocked state. Representative examples of bowstring nocking members are described in U.S. Pat. Nos. 4,909,233, 5,787,870, and 5,499,620. Additionally, one type of bowstring nocking member in particular is shown in U.S. Pat. No. 5,361,747 having a ball-shaped configuration which fits in a spherically concave receptacle of a nock element at the end of an arrow. This arrangement has several advantages, among which include providing a constant contact surface at all stages of bowstring deflection which prevents an undesirable clamping effect at the nock element. Furthermore, this arrangement has the ability to transfer force on the end of an arrow without generating tilting forces at the end of the arrow which can affect shooting accuracy.

Various types of bowstring release mechanisms have been developed to utilize the particular ball-type bowstring nocking member shown in the '747 patent, and thereby realize its benefits. One example is shown in U.S. Pat. No. 5,685,286 disclosing a bowstring release device for an archery bow which seizes opposite sides of a ball-shaped nocking member by means of a pair of gripping arms 16, 18 having sockets 22, 24, respectively. Similarly, in U.S. Pat. No. 5,680,851, a release device is shown also having a pair of spring biased gripping arms with a semispherical socket for engaging the spherical ball-shaped nocking member. A notable disadvantage of both the '286 and '851 patents, however, is that the rim of each of the sockets may experience substantial wear at the tip portions from sliding against the exiting nocking member.

In summary, therefore, there is a need for a bowstring release mechanism and system designed for use on a crossbow which incorporates a bowstring nocking member preferably having a ball-shaped configuration. Additionally, such a mechanism and system should minimize the frictional wear typically associated with the trigger and bowstring release mechanics of crossbows.

BRIEF SUMMARY OF THE INVENTION

It is therefore an object of the present invention to provide a simple and efficient bowstring release system for crossbows having a nocking member mounted on the bowstring with a preferably ball-shaped configuration to reduce friction and wear on the bowstring.

It is a further object of the present invention to provide an accurate and durable bowstring release system which releases the nocking member in a smooth, and controlled manner, thereby preventing undesirable transverse forces during release, and reducing friction and wear along the contact surfaces of the system.

It is a further object of the present invention to provide a bowstring release system which maintains the bowstring in the cocked position prior to release by frontally obstructing the nocking member without seizing the nocking member or directly contacting the bowstring itself.

The present invention is for a bowstring release system for crossbows having a crossbow frame with barrel and handle portions, and a bow horizontally mounted on a forward part of the barrel portion. The bow has a bowstring with a nocking member mounted thereon for engaging a nock portion of an arrow. The bowstring release system comprises upper and lower catch surfaces positioned near a rearward part of the barrel portion in vertical relation to each other and having a release passage defined therebetween. The bowstring release system also has actuating means for vertically moving the upper and lower catch surfaces relative to each other between a closed position and an open position. In the closed position, the upper and lower catch surfaces block passage of the cocked nocking member through a release passage without seizing the cocked nocking member. And in the open position, the cocked nocking member passes through the release passage to propel the arrow via the nock portion.

DETAILED DESCRIPTION OF THE PREFERRED EMBODIMENTS

Figure 1:
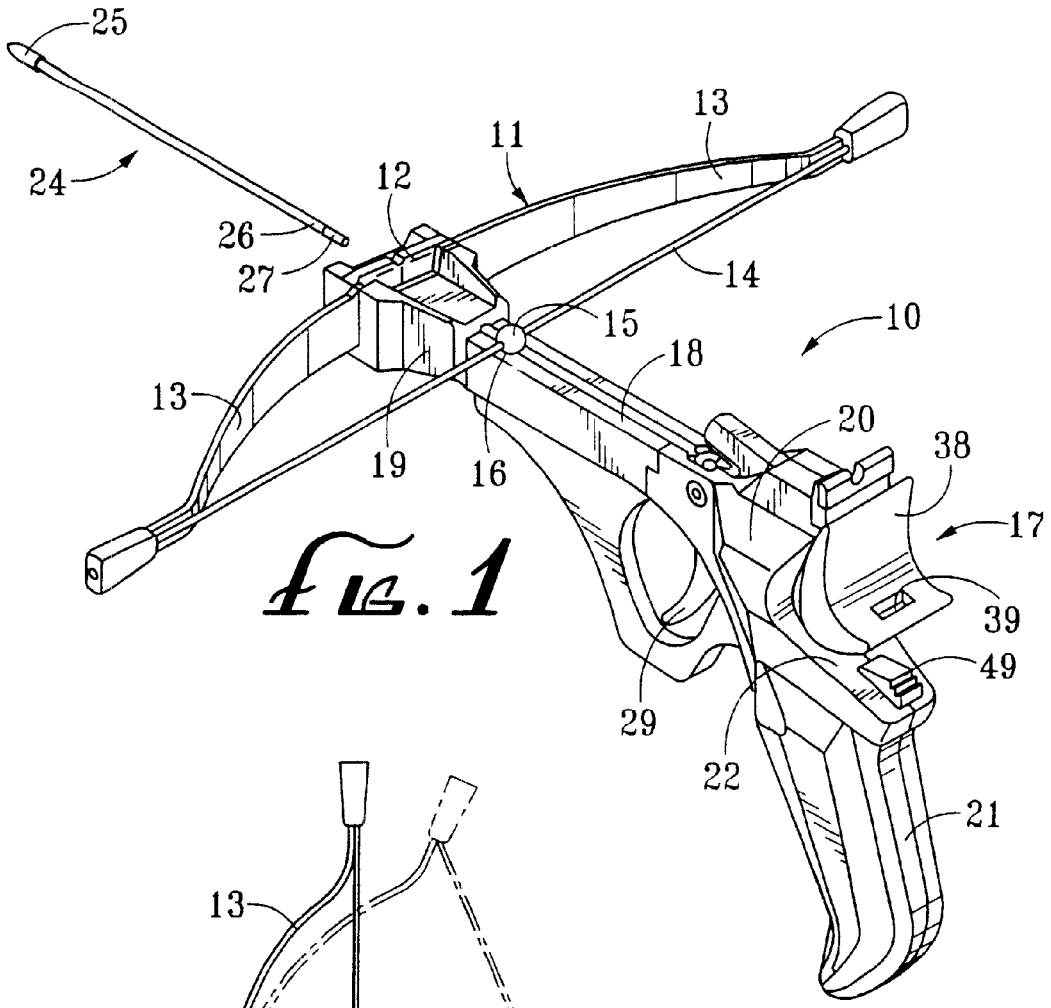
FIG. 1 is a perspective view of the hand-held pistol type embodiment of the crossbow featuring the present invention.
Figure 2:
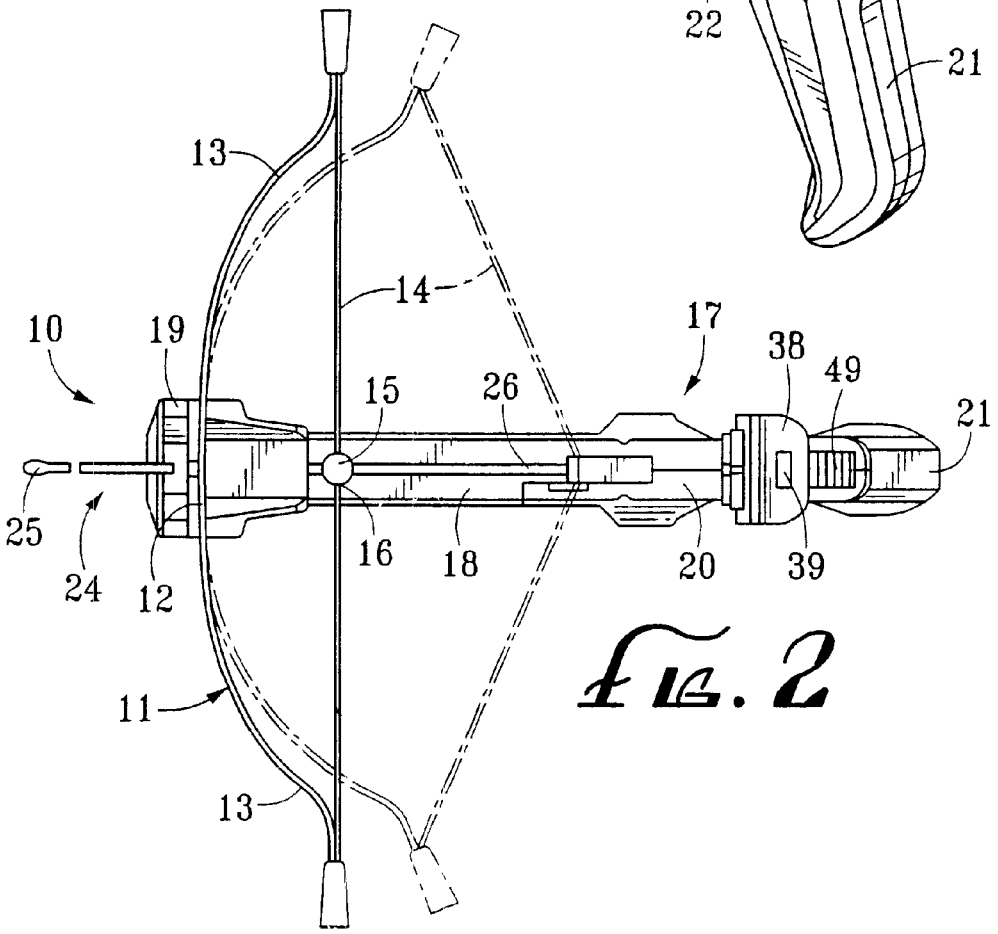
FIG. 2 is a top view of the crossbow in FIG. 1, illustrating deflection of the bow and bowstring when in a cocked position.

Referring now to the drawings, FIGS. 1–8 show a first preferred embodiment of a crossbow having a hand-held pistol type configuration, generally indicated at reference character 10. The crossbow 10 is designed to receive, engage, and discharge an arrow, generally indicated at reference character 24, having a leading end 25 and a tail end 26 with a nock portion 27. As can be seen in FIGS. 1 and 2, the crossbow 10 includes a bow, generally indicated at reference character 11, which is mounted on a crossbow stock, generally indicated at reference character 17. In particular, a riser portion 12 of the bow 11 is mounted at a forward portion 19 of a barrel 18 of the crossbow stock 17. A rearward portion 20 of the barrel 18 is connected to a handle portion 21 of the crossbow stock 17 which is used for grasping and handling of the crossbow 10. The bow 11 has a pair of bow limbs 13 connected at their distal ends by a bowstring 14. A nocking member 15 is centrally mounted on the bowstring 14 for engaging the nock portion 27 of an arrow 24. In this regard, the nock portion 27 has a recess 28 (FIGS. 3A, 4A, and 5) suitably adapted to releasably engage the nocking member 15, as will be discussed in detail below.

Figure 3A:
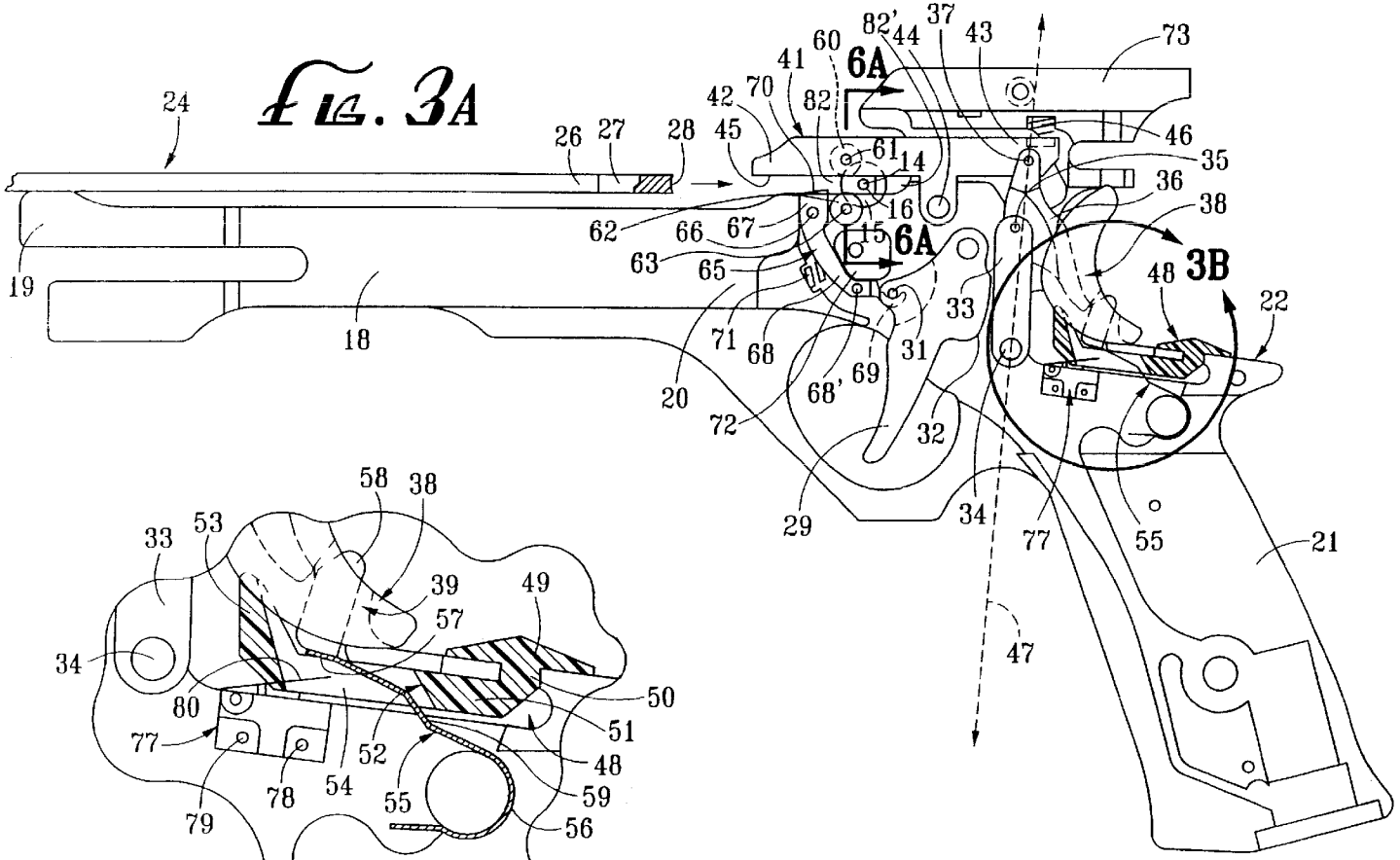
FIG. 3A is a schematic view of the crossbow stock upon cocking and releasably locking the nocking member and bowstring, but prior to loading of an arrow.
Figure 3B:
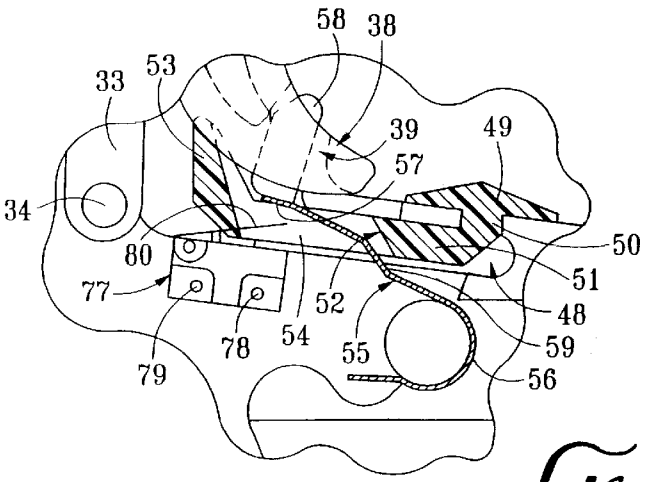
FIG. 3B is an enlarged view of Circle 3B in FIG. 3A showing in detail the engagement of the primary safety mechanism.
Figure 4A:
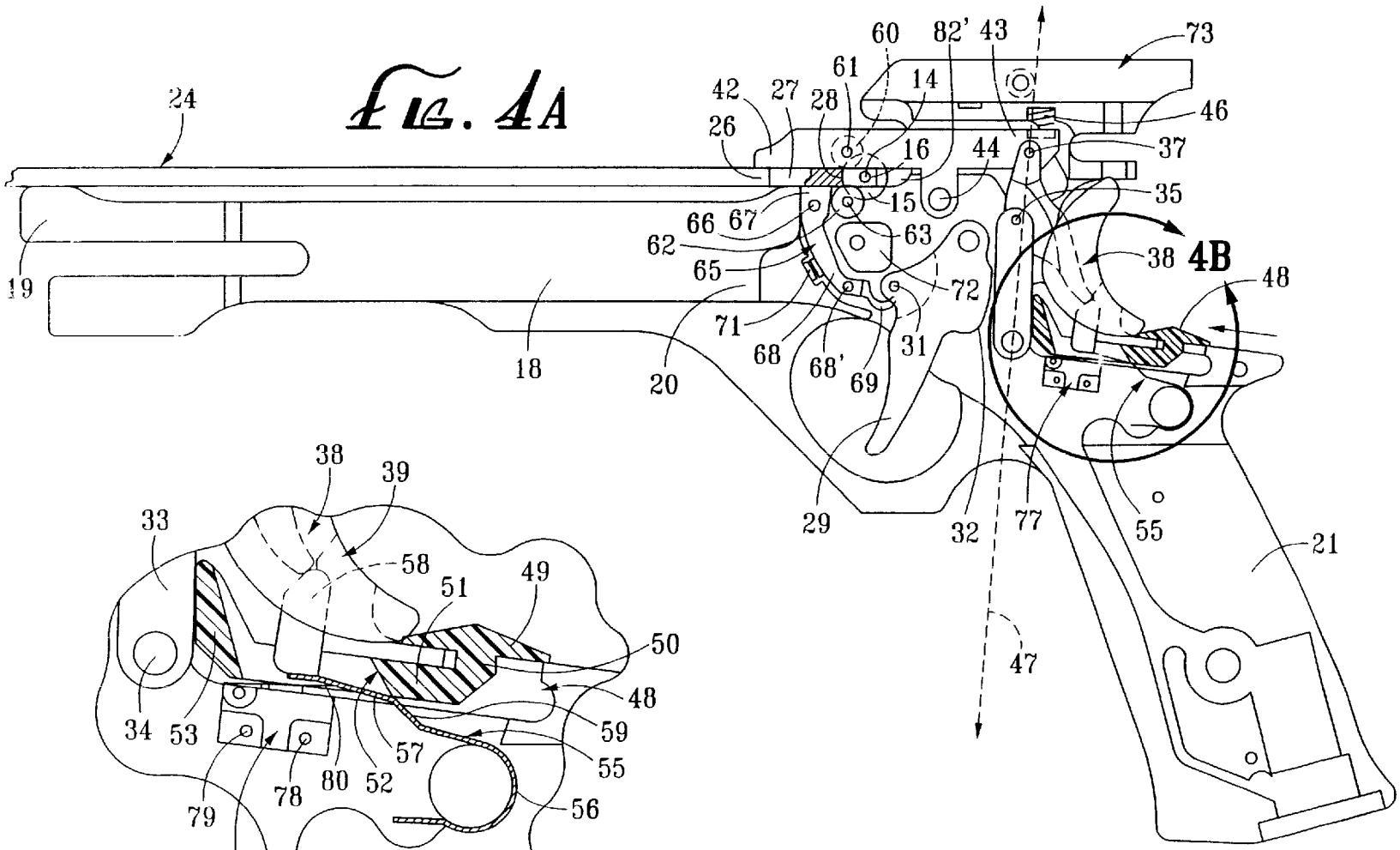
FIG. 4A is a schematic view of the crossbow stock following FIG. 3A wherein an arrow is now loaded, and the safety device is disengaged.
Figure 4B:
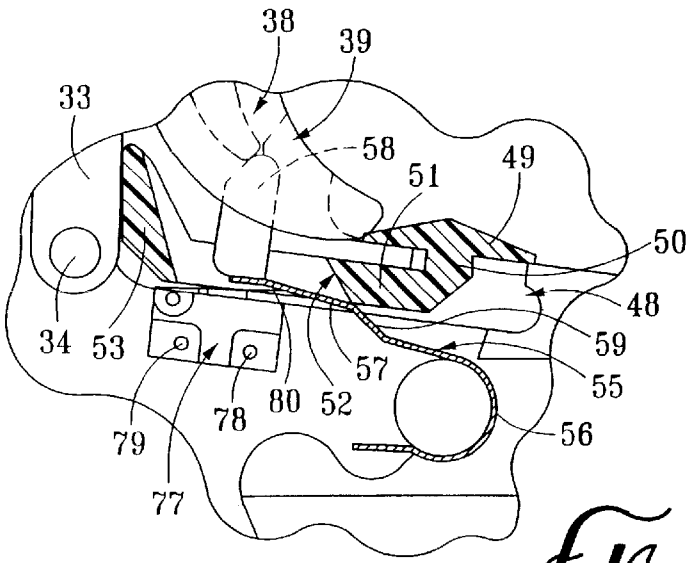
FIG. 4B is an enlarged view of Circle 4B in FIG. 4A showing in detail the disengagement of the primary safety mechanism, and closure of the electrical circuit.
Figures 5, 7:
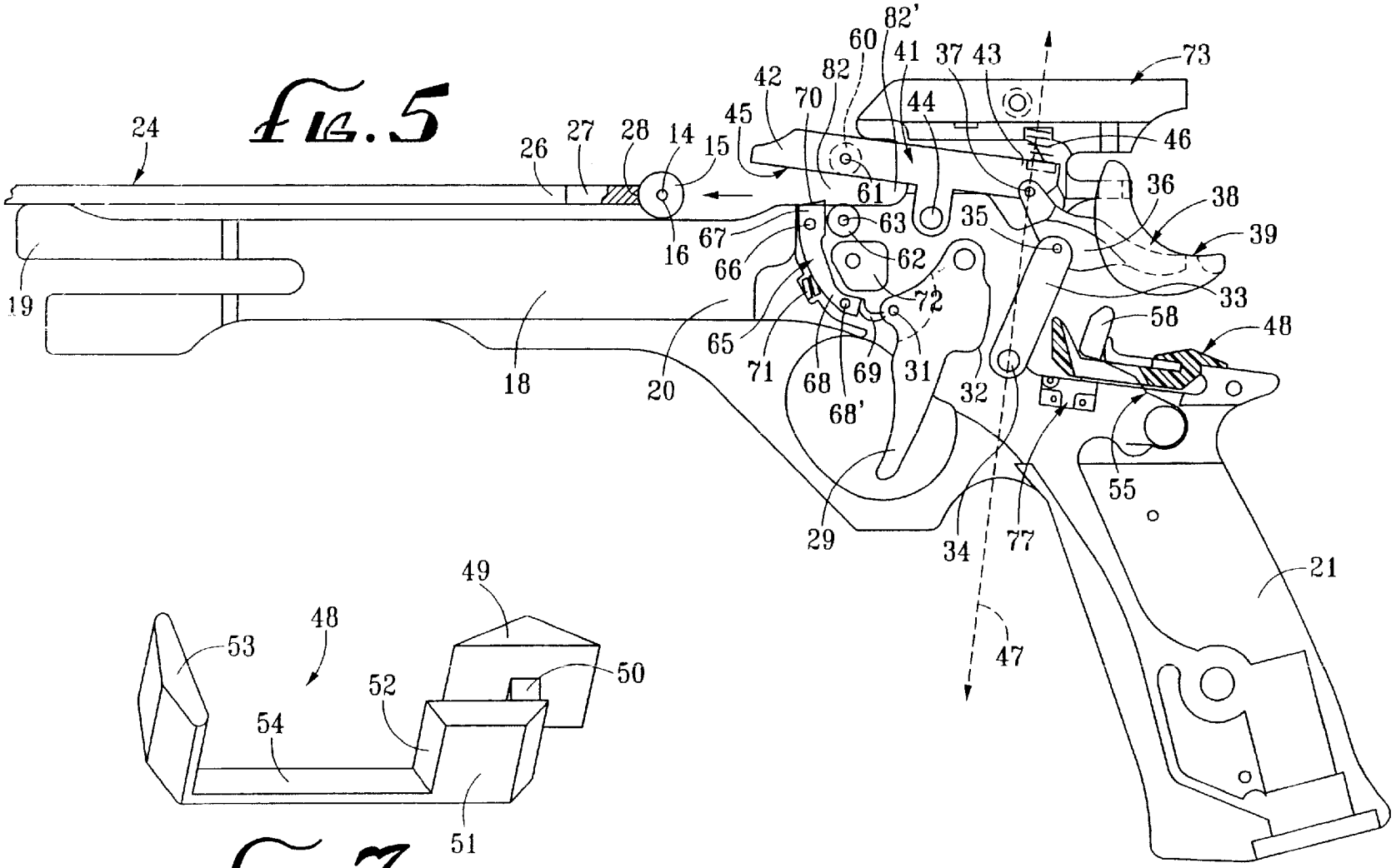
FIG. 5 is a schematic view of the crossbow stock following FIG. 4A, wherein the trigger mechanism is actuated, the bowstring and nocking member released, and the arrow discharged.
FIG. 7 is an enlarged perspective view of the slider component of the safety mechanism.

One important feature of the crossbow 10 is a bowstring release mechanism and system, shown in FIGS. 3A–6B, which operates to hold and release the bowstring 14 by way of the nocking member 15. The bowstring release mechanism and system is generally comprised c upper and lower catch surfaces, 64 and 64' respectively (see FIGS. 6A and 6B), positioned at the rearward portion 20 of the crossbow stock 17 in vertical relation to each other. A release passage 82 is formed between the catch surfaces 64, 64'. The release passage 82 leads into a retaining area 82' where a cocked nocking member 15 (along with the bowstring 14) is held prior to being discharged through the release passage 82. Preferably, the upper and lower catch surfaces 64, 64' are the curvilinear contact surfaces of upper and lower rollers 60, 62 which are adapted to spin freely about rotational axes 61, 63 respectively. The upper end lower catch surfaces 64, 64' are thus preferably continuous rolling surfaces having circular cross-sections as shown in FIGS. 3A, 4A, and 5. Alternatively, however, it is appreciated that the upper and lower catch surfaces 64, 64' may be rigidly fixed to prevent any movement, rotational or otherwise.

Figure 6B:
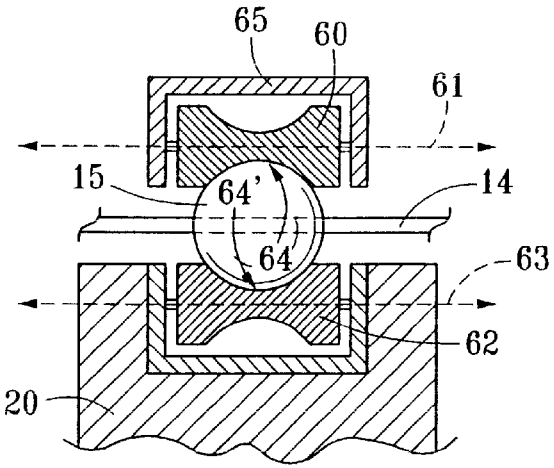
FIG. 6B is a cross-sectional view of the bowstring release mechanism following FIG. 6A, and shown in the open position to release the nocking member and bowstring.
Figure 6A:
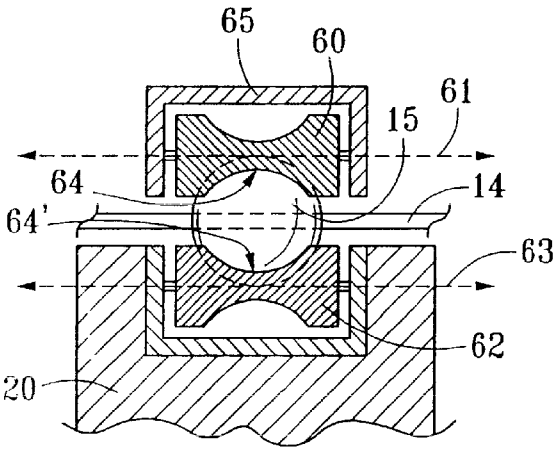
FIG. 6A is a cross-sectional view of the bowstring release mechanism taken along line 6A of FIG. 3A, and shown in the closed position.

Furthermore, as can be seen in FIGS. 6A and 6B showing a cross-sectional view taken along line 6A of FIG. 3A, each of the upper and lower rollers 60, 62 has a substantially hourglass configuration with a hyperbolic cross-section, i.e. the center portion has a narrower width than the opposing ends. Thus the upper catch surface 64 of the upper roller 60 and the adjacent lower catch surface 64' of the lower roller 62 are concave relative to each other when viewed along a longitudinal axis (not shown) of the barrel 18. Moreover, the concave configuration of each of the catch surfaces 64, 64' is adapted to contour to the particular shape of the nocking member 15. As shown in the figures, the nocking member 15 preferably has a substantially ball-shaped configuration with a bore 16 through which the bowstring 14 extends. Thus the recess 28 of the nock portion 27 of an arrow 24 has a semi-spherically concave configuration which seats the ball-shaped nocking member 15. Alternatively, however, it is appreciated that the nocking member 15 may also have various non-spherical, curvilinear shapes, with correspondingly contoured upper catch surface, lower catch surface, and nocking portion recess 28.

Additionally, the bowstring release mechanism and system comprises actuating means for vertically moving the upper and lower catch surfaces 64, 64' relative to each other between a closed position (FIGS. 3A and 4A), and an open position (FIG. 5), thereby narrowing or widening the release passage 82, respectively. Preferably, as can be seen in the figures, the upper catch surface 64 (of the upper roller 60) is mounted on a front limb 42 of a sear arm 41 which is pivotally connected to the crossbow stock 17 at a sear arm pivot joint 44. As can be seen in the figures, the upper catch surface 64 is preferably positioned away from the tip of the front limb 42, to enable a abutment surface 45 to clamp down an inserted arrow 24 by pressing it against an opposite brace surface connected to the crossbow stock 17. The sear arm pivot joint 44 is positioned between the front limb 42 and a rear limb 43 extending opposite the front limb 42 of the sear arm 41. The sear arm 41 is thus configured to rock about the sear arm pivot joint 44 by applying an upward locking force or an opposite downward unlocking force on the rear limb 43.

To produce the upward locking and downward unlocking forces which actuate the sear arm 41, the rear limb 43 is pivotally connected to a coupler link 36 at a rear pivot joint 37. The coupler link 36 is in turn pivotally connected to a trigger link 33 at an upper trigger link joint 35, and the trigger link 33 is pivotally connected to the crossbow stock 17 at a lower trigger link pivot joint 34. Furthermore, a resiliently biasing means, such as a coil spring 46, is positioned above the rear limb 43 which exerts the downward unlocking force against the rear limb 43. It is notable that due to the downward unlocking force exerted by the coil spring 46 on the rear limb 43 of the sear arm 41, alignment of the upper trigger ink pivot joint 35 along the alignment axis 47 is inherently unstable, with the upper trigger link pivot joint 35 having a tendency to push away from the axis 47. It is further notable that because the rear pivot joint 37 and upper trigger link pivot joint 35 are not pivotally connected to the crossbow stock 17, these joints are capable of being translationally displaced relative to the crossbow stock 17.

In this manner, the relative position of the upper trigger link pivot joint 35 with respect to the alignment axis 47 will ultimately determine the open or closed positioning of the sear arm 41. The rear limb 43 of the sear arm 41 will reach its highest point when the upper trigger link pivot joint 35 is collinear with the rear pivot joint 37 and the lower trigger link pivot joint 34 along an alignment axis 47. And consequently, the front limb 42 of the sear arm 41, together with the upper catch surface 64, will be simultaneously lowered to the closed position, as shown in FIG. 4A. In providing the upward locking force necessary to pivot the sear arm 41 to the closed position, a pressure plate 38 is connected to the coupler link 36 for actuating the coupler link 36. By pushing against the pressure plate 38, the trigger link 33 pivots about the lower trigger link pivot joint 34 such that the upper trigger link pivot joint 35 crosses the alignment axis 47. This consequently raises pivot point 37 of the coupler link 33. As can be seen in FIG. 4A when in the ready position, the upper trigger link pivot joint 35 is positioned slightly forward of the alignment axis 47 and is stabilized and prevented from further movement by means of a trigger 29 which abuts the trigger link 33 along an abutting end 32.

Once in the releasably locked position, actuation of the trigger 29 causes the abutting end 32 to urge the trigger link 33 rearward past the alignment axis 47. As the upper trigger link pivot joint 35 moves rearward past the alignment axis 47, the compressed sear arm spring 46 provides the necessary momentum to accelerate the upper trigger link far past the alignment axis 47. This movement lowers the rear limb 43 of the sear arm 41 and consequently raises the front limb 42.

Generally, when the upper and lower rollers 60, 62 are in the closed position, as shown in FIG. 6A, the upper and lower catch surfaces 64, 64' block passage of a cocked nocking member 15 through the release passage 82. They do so by abutting a frontal portion of the cocked nocking member 15 to keep it contained within the retaining area 82'. It is notable that because only the forward section of the ball-shaped nocking member 15 abuts against the catch surfaces, the nocking member 15 is not seized by the upper and lower catch surfaces 64, 64'. It is appreciated that the term "blocking" is defined and used herein to mean preventing movement in one or more predetermined directions, whereas the term "seizing" is defined and used herein as preventing movement in all directions by a pair of equal and opposite forces, i.e. complete relative immobility with respect to the seizing instrument or object.

When in the open position, as shown in FIG. 6B, the upper and lower catch surfaces 64, 64' are sufficiently separated to enable the cock nocking member 15 to pass through the release passage 82. As can be seen in the figures, the use of upper and lower rollers 60, 62 minimizes or altogether eliminates slip between the nocking member 15 and the rolling catch surfaces 64, 64'. Alternatively, however, where the catch surfaces 64, 64' are rigidly fixed to the crossbow stock 17, the nocking member 15 must pass through the release passage 82 by sliding against the catch surfaces 64, 64'. It is appreciated that wear caused by slip friction between the surfaces is effectively reduced for repeated use cycles due to the curved and contoured catch surfaces 64, 64' which provide relatively even pressure distribution along the contact and separation points between the nocking member 15 and the catch surfaces 64, 64'. In this manner, the ball-shaped nocking member 15 may separate smoothly and evenly from the catch surfaces 64, 64' to propel the arrow 24 much more accurately.

Another important feature of the crossbow 10 is a dry fire prevention mechanism which operates to disable operation of the trigger 29 while an arrow 24 is not positioned to be discharged. As can be seen in the figures, the dry fire prevention mechanism is preferably a catch arm 65 which is pivotally connected to the crossbow stock 17 at a catch arm pivot joint 66. The catch arm 65 has a top end 67 adjacent the lower roller 62 and a bottom end 68 having a first catch element 69 which is preferably a hook 69. The catch arm pivot joint 66 is preferably intermediately positioned between the top and bottom ends 67, 68. Resiliently biasing means 71, such as a coil spring 71, is provided to urge the hook 69 of the catch arm 65 into releasable engagement with a second catch element 31 of the trigger mechanism 29 when no arrow 24 is positioned to be discharged. As shown in the figures, the second catch element is preferably a catch pin 31. Furthermore, an arrow contacting surface 70 is located at the top end 67 of the catch arm 65, which is preferably positively inclined towards the rear of the crossbow 10.

Operation of the dry fire prevention mechanism can be best seen in FIGS. 3A, 4A, and 5 which illustrate the progression of loading and firing an arrow 24. Prior to insertion of the arrow 24, the catch arm 65 preferably abuts against a stopper block 72 and the hook 69 is releasably engaged to catch pin 31 such that the trigger mechanism 29 may not be actuated and the crossbow 10 is non-operational. As can be seen in FIG. 4A upon the insertion of an arrow 24 adjacent the abutment surface 45, the tail end 26 of arrow 24 presses against the arrow contacting surface 70 to thereby pivot the catch arm 65 about catch arm pivot pin 66. Consequently, the resulting pivoting action of the catch arm 65 is sufficient to disengage and clear the hook 69 from the pin 31. As can be seen in FIG. 5, upon release of the nocking member 15, the arrow contacting surface 70 returns to its unpivoted position and the catch arm 65 once again abuts the stopper block 72. Furthermore, as can be seen in FIGS. 3A, 4A, 5, the catch arm 65 has means for manually overriding engagement of the first and second catch elements. This is preferably an override actuator arm 68' transversely extending from the catch arm 65 and accessible by the user.

Figure 8:
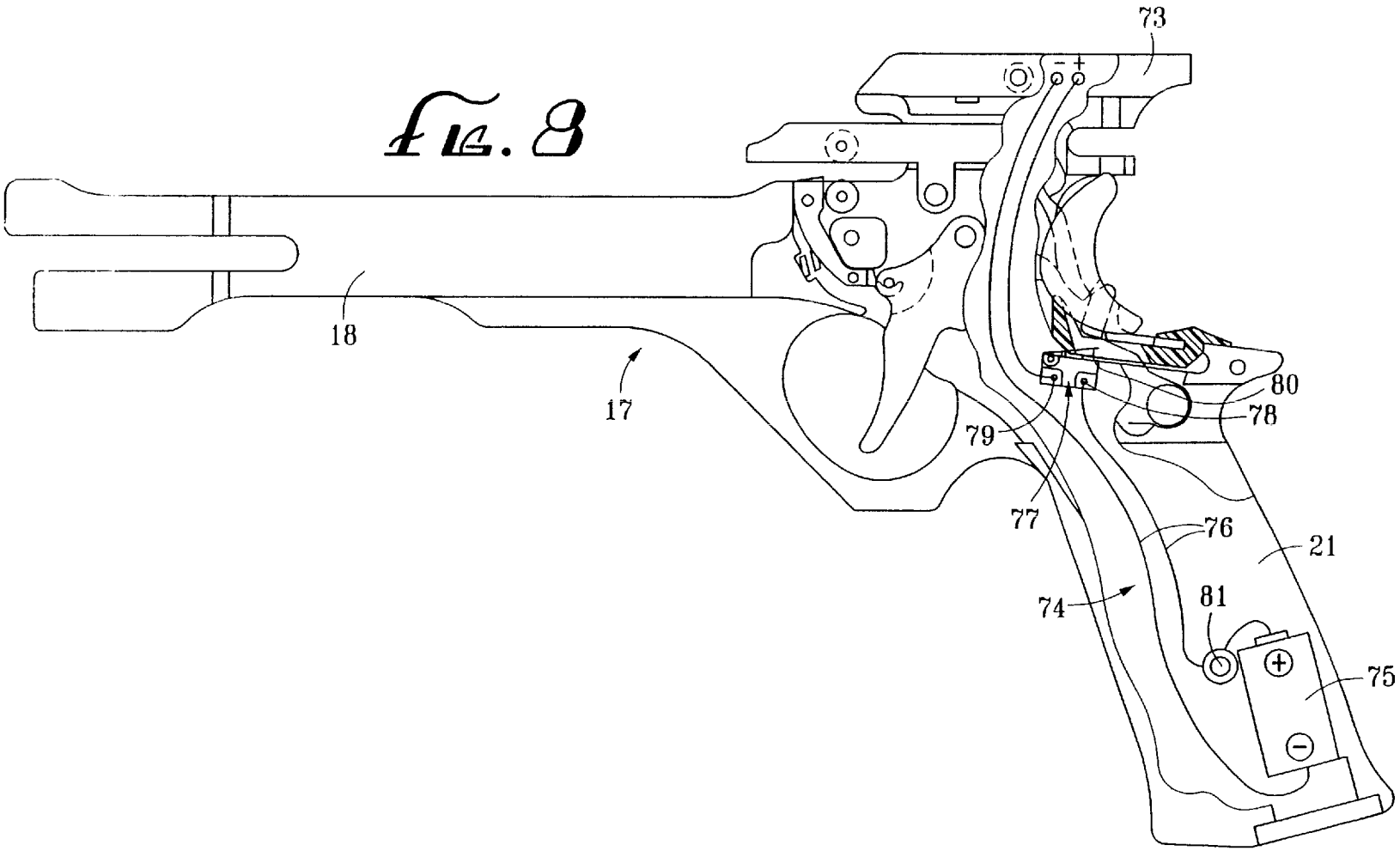
FIG. 8 is a partially cut-away schematic view of the crossbow stock illustrating the electric circuit for the laser.

A third important feature of the crossbow 10 is a laser circuit activation system which utilizes a safety component of the trigger mechanism 29 to activate a laser generating means, generally indicated by reference character 73. FIG. 8 generally shows a schematic view of an electrical circuit of the laser generating means 73, generally indicated by reference character 74. The electrical circuit 74 comprises an energy source, such as a battery 75, connected by electrical wiring 76 to a primary switch 77 positioned adjacent a trigger safety device. The trigger safety device comprises a slider component 48 best shown in FIG. 7. The slider component 48 has a reset shoe 53 connected to a reset extension arm 54. And the reset extension arm 54 is connected to a cam 51 having a reversed incline surface 52. The cam 51 connects to a thumb switch 49 by means of a neck 50. As shown in FIG. 3A, the slider component 48 is seated along a plane side surface 22 of a top end of the handle portion 21. Furthermore, the trigger safety device has a leaf spring 55 having a fixed end 56 and a movable end 57. A latch portion is connected to the movable end 57 which engages a safety aperture 39 located on the pressure plane 38 to releasably lock the trigger mechanism 29.

As shown in FIGS. 3B and 4B, the trigger safety device may be disengaged when the thumb switch 49 is urged forward such that the reverse inclined surface 52 contacts and steps over step surface 59 of the leaf spring 55. This causes the leaf spring 55 to bias sufficiently downward such that the latch portion 58 is disengaged from the safety aperture 39. Consequently, and simultaneously, the movable end 57 of the leaf spring 55 depresses a switch actuator arm 80 of the primary switch 77. This action bridges the positive terminal 78 with a negative terminal 79 to complete the electrical circuit 74 of the laser generating means 73.

In this manner, when the safety device is disengaged to enable discharge of an arrow 24, the laser means 73 is simultaneously activated to produce a laser beam (not shown). And upon discharging the arrow 24 from the crossbow 10, the pivoting movement of the trigger link 33 causes the trigger link 33 to abuttingly urge the reset shoe 53 rearward. This in turn moves the slider component 48 back to the safety position which releases the leaf spring 55 and automatically resets the safety device to prevent accidental discharge. Consequently, the leaf spring 55 also releases the switch actuator arm 80 to thereby open the electrical circuit 74 and turn off the laser 73. This helps conserve energy needed to power the laser means 73 by supplying power only immediately prior to discharging the crossbow 10, i.e. when the safety is disengaged. Furthermore, a secondary switch 81 may be provided as a manual override for turning the laser 73 on and off.

Figure 9:
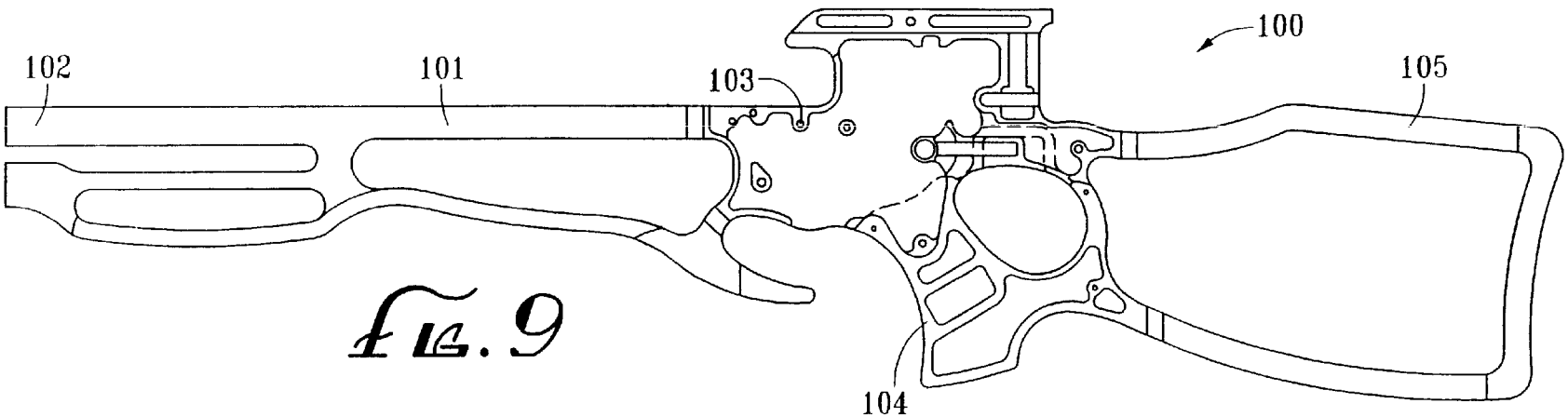
FIG. 9 is a skeletal schematic view of a second preferred embodiment of the crossbow, having a rifle configuration.
Figure 10:
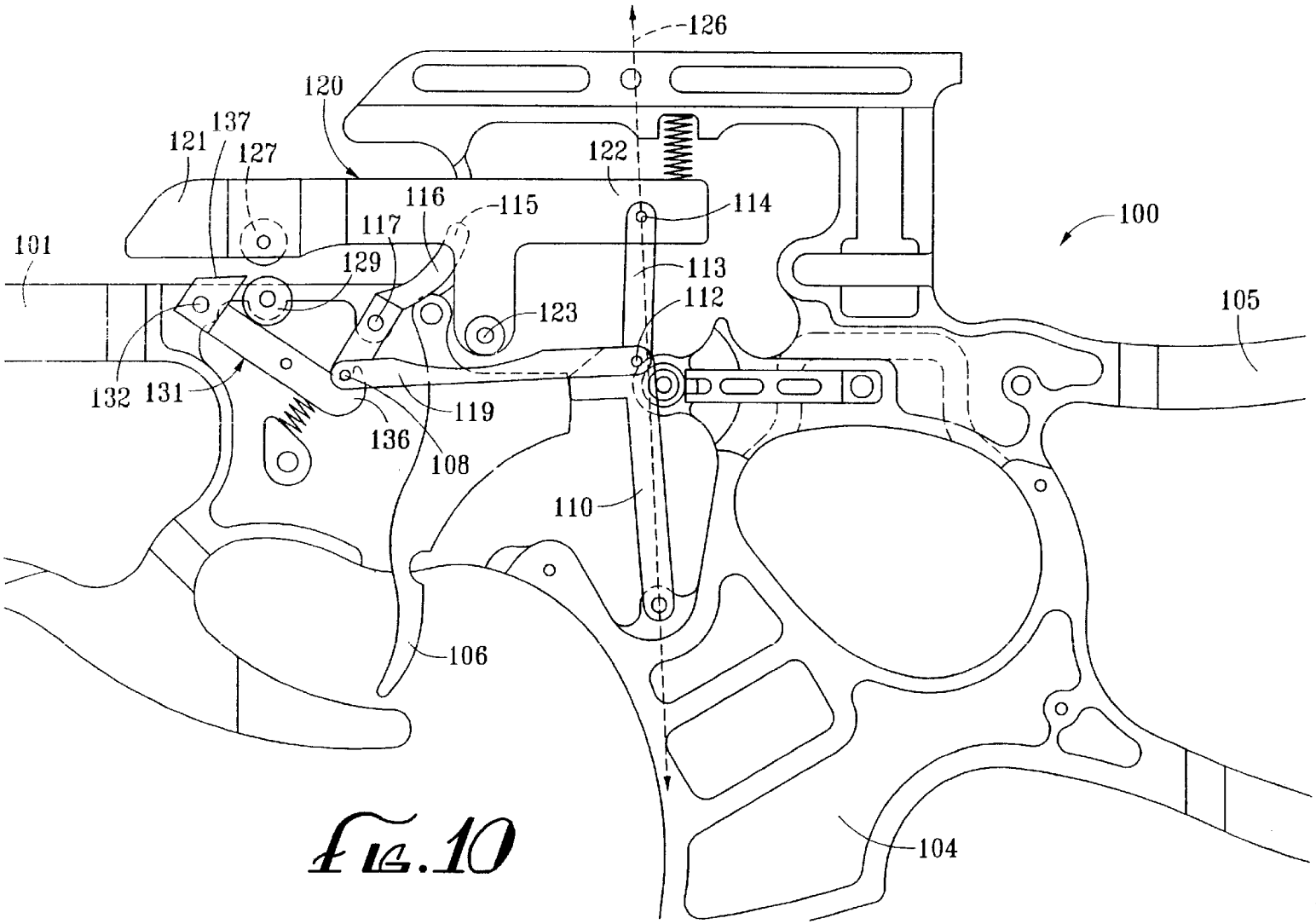
FIG. 10 is a detailed view of the rifle type crossbow of FIG. 9, shown in a closed position with a cocked nocking member positioned to be discharged.
Figure 11:
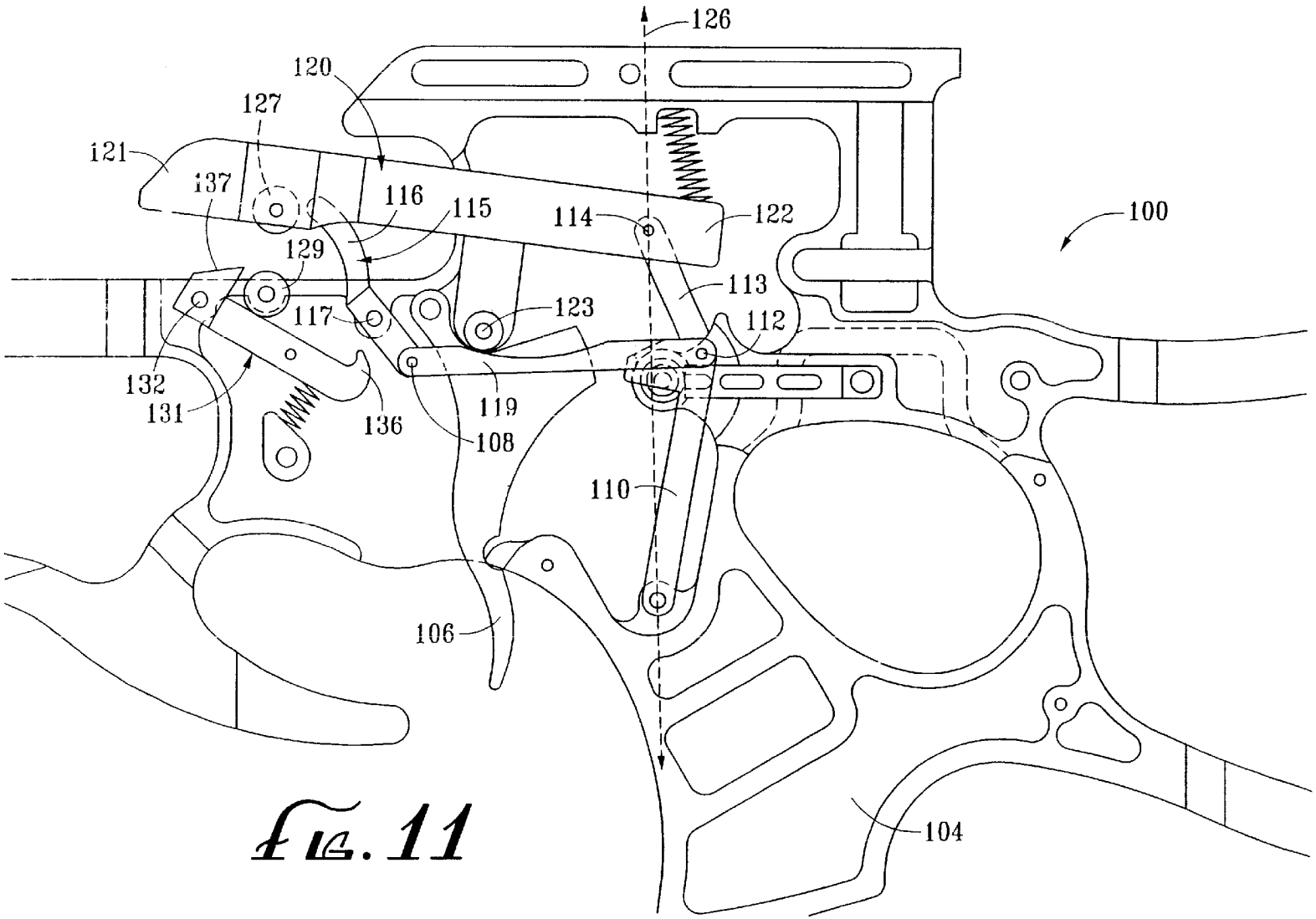
FIG. 11 is a detailed view of the rifle type crossbow following FIG. 10, shown in the open position after discharging an arrow.

A second preferred embodiment of the cross bow is shown in FIGS. 9–11, having a crossbow stock with a rifle-type configuration, generally indicated by reference character 100. Similar to the pistol-type crossbow 10 of the first preferred embodiment, the rifle crossbow stock 100 has an elongated barrel 101 with a front portion 102 and a rear portion 103. Additionally, a shoulder rest 105 extends to the rear of the handle portion 104.

As can be best seen in FIG. 10, the rifle crossbow stock 100 also preferably incorporates a bowstring release mechanism and system having an upper roller 127 and a lower roller 129. Upper roller 127 is also rotatably connected to a sear arm 120 having a front portion 121 and an oppositely directed rear portion 122, with a sear arm 120 pivoting about a sear arm pivot axis 123. While the trigger mechanism shown in FIG. 10 differs from that of the pistol-type crossbow 10 in FIGS. 1–8, the bowstring release mechanism and system operate in essentially the same manner.

Likewise, the rifle-type crossbow 100 also has a safety mechanism for preventing dry fire which utilizes a catch arm 131 pivotally connected at a catch arm pivot joint 132 to the crossbow stock 100. An arrow contacting surface 137 similarly extends from a top end of the catch arm 131 into the path of an arrow for pivoting the catch arm 131 about the catch arm pivot joint 132. And the catch arm 131 has a hook 136 which engages a catch pin 108 of the trigger mechanism 106. In this embodiment, however, the engagement pin 108 is a pivoting joint between a cocking lever 115, having an upper end 116 and a pivot axis 117, and a connecting safety arm 119. In this second embodiment, the safety arm 119 has an analogous function to the pressure plate 38 of the first preferred embodiment. Thus, the safety arm 119 connects to a pivot joint 112 connecting to a coupler link 113 and a trigger link 110. The trigger link 110 is pivotally connected to the rear limb 122 of the sear arm 120 at a rear pivot joint 114. Similar to the alignment axis 47 of the first preferred embodiment, the alignment axis 126 of the second preferred embodiment is the equilibrium threshold which must be overcome to cross between the open and closed positions.

The present embodiments of this invention are thus to be considered in all respects as illustrative and restrictive; the scope of the invention being indicated by the appended claims rather than by the foregoing description. All changes which come within the meaning and range of equivalency of the claims are intended to be embraced therein.

I claim:

1. A bowstring release mechanism for crossbows having a bow horizontally mounted at a forward portion of a crossbow stock, said bow having a bowstring with a nocking member mounted thereon for releasably engaging a nock portion of an arrow, said bowstring release mechanism comprising:

upper and lower catch surfaces positioned at a rearward portion of said crossbow stock in vertical relation to each other and having a release passage defined therebetween; and actuating means for vertically moving said upper and lower catch surfaces relative to each other between a closed position wherein said upper and lower catch surfaces block passage of a cocked nocking member through said release passage without seizing said cocked nocking member, and an open position wherein said cocked nocking member passes through said release passage to propel said arrow via said nock portion.

2. The mechanism as in claim 1, wherein said upper and lower catch surfaces are adapted to contouredly contact a substantially ball-shaped nocking member.

3. The mechanism as in claim 2, wherein said upper and lower catch surfaces are rotatably connected to said rearward portion of said crossbow stock.

4. The mechanism as in claim 1, wherein said upper catch surface is located on a front limb of a sear pivotally connected to said crossbow stock, said sear including a rear limb opposite said front limb.

5. The mechanism as in claim 4, wherein said actuating means includes releasably locking means for providing an upward locking force against the rear limb of said sear whereby said front limb is forced downward to said closed position, and trigger means for replacing the upward locking force against the rear limb of said sear with a downward pulling force whereby said front limb is forced upward to said open position.

6. The mechanism as in claim 5, wherein said front limb of said sear has an abutment surface which abuts a tail end of said arrow against a brace surface connected to said crossbow stock when in said closed position, whereby said arrow is captively held prior to discharge.

7. A bowstring release system for crossbows having a bow horizontally mounted at a forward portion of a crossbow stock, said bow having a bowstring for discharging an arrow, said bowstring release system comprising:

a nocking member mounted on said bowstring for releasably engaging a nock portion of said arrow;

upper and lower catch surfaces positioned at a rearward portion of said crossbow stock in vertical relation to each other and having a release passage defined therebetween; and actuating means for vertically moving said upper and lower catch surfaces relative to each other between a closed position wherein said upper and lower catch surfaces block passage of a cocked nocking member through said release passage without seizing said cocked nocking member, and an open position wherein said cocked nocking member passes through said release passage to propel said arrow via said nock portion.

8. The system as in claim 7, wherein said nocking member has a substantially ball-shaped configuration, and wherein said upper and lower catch surfaces are adapted to contouredly contact said substantially ball-shaped nocking member.

9. The system as in claim 8, wherein said upper and lower catch surfaces are rotatably connected to said rearward portion of said crossbow stock.

10. The system as in claim 7, wherein said upper catch surface is located on a front limb of a sear pivotally connected to said crossbow stock, said sear including a rear limb opposite said front limb.

11. The system as in claim 10, wherein said actuating means includes releasably locking means for providing an upward locking force against the rear limb of said sear whereby said front limb is forced downward to said closed position, and trigger means for replacing the upward locking force against the rear limb of said sear with a downward pulling force whereby said front limb is forced upward to said open position.

12. The system as in claim 11, wherein said front limb of said sear has an abutment surface which abuts a tail end of said arrow against a brace surface connected to said crossbow stock when in said closed position, whereby said arrow is captively held prior to discharge.

* * * * *